US007306556B2

(12) United States Patent
Pitkämäki et al.

(10) Patent No.: US 7,306,556 B2
(45) Date of Patent: Dec. 11, 2007

(54) ENTRAINMENT DEVICE FOR A CENTRIFUGAL ROTOR

(75) Inventors: Jouko Juhani Pitkämäki, Tumba (SE); Sven-Ake Nilsson, Gnesta (SE)

(73) Assignee: Alfa Laval Corporate AB, Lind (SE)

( * ) Notice: Subject to any disclaimer, the term of this patent is extended or adjusted under 35 U.S.C. 154(b) by 0 days.

(21) Appl. No.: 10/577,622

(22) PCT Filed: Oct. 14, 2004

(86) PCT No.: PCT/SE2004/001473

§ 371 (c)(1),
(2), (4) Date: Apr. 28, 2006

(87) PCT Pub. No.: WO2005/044462

PCT Pub. Date: May 19, 2005

(65) Prior Publication Data

US 2007/0032363 A1 Feb. 8, 2007

(30) Foreign Application Priority Data

Nov. 7, 2003 (SE) ..... 0302957

(51) Int. Cl.
*B04B 11/06* (2006.01)

(52) U.S. Cl. ..... 494/67

(58) Field of Classification Search ..... 494/43, 494/64, 67–74, 85; 210/377
See application file for complete search history.

(56) References Cited

U.S. PATENT DOCUMENTS 1,277,676 A * 9/1918 Wright ..... 494/53
2,668,008 A * 2/1954 Spross ..... 494/41
3,990,631 A 11/1976 Schall
4,701,158 A 10/1987 Inge et al.
5,045,049 A * 9/1991 Lantz ..... 494/70
5,052,996 A 10/1991 Lantz
5,186,708 A 2/1993 Stroucken et al.
5,362,292 A 11/1994 Borgstrom et al.
5,518,494 A * 5/1996 Borgstrom et al. ..... 494/56
5,720,705 A 2/1998 Inge et al.
6,533,713 B1 * 3/2003 Borgstrom et al. ..... 494/66
2007/0032363 A1 * 2/2007 Pitkamaki et al. ..... 494/67

FOREIGN PATENT DOCUMENTS

WO 91/12082 A1 * 8/1991

OTHER PUBLICATIONS

International Search Report dated Feb. 2, 2005.

* cited by examiner

*Primary Examiner*—Charles E. Cooley
(74) *Attorney, Agent, or Firm*—Michaud-Duffy Group LLP

(57) ABSTRACT

An entrainment device for a centrifugal rotor, which is rotatable about a central rotational axis, having a number of entrainment members arranged in said space for entrainment of entering liquid in the rotation of the centrifugal rotor. The entrainment device comprises a first component, which surrounds the rotational axis and has at least one first projection, which has a radial extension, and a second component, which surrounds the rotational axis and has at least a second projection, which also has a radial extension. The second component is axially insertable in said central space to a position, in which said second projection is present adjacent to said first projection . When the entrainment devices are in place in the central space, a locking member is applicable in releasable engagement with said projection so that the second component is prevented from moving axially relative the first component.

18 Claims, 5 Drawing Sheets

ENTRAINMENT DEVICE FOR A CENTRIFUGAL ROTOR

CROSS-REFERENCE TO RELATED APPLICATIONS

This application claims priority to International Patent Application No. PCT/SE2004/001473 filed on Oct. 14, 2004, which claims priority to Swedish Patent Application No. 0302957-6 filed on Nov. 7, 2003, the subject matter of these patent documents is incorporated by reference herein in its entirety.

The present invention relates to an entrainment device for a centrifugal rotor, which latter comprising a rotor body, which is rotatable about a central rotational axis and delimits a separation chamber, and an inlet device which is connected to the rotor body for rotation with the same and which delimits a central space for receiving of liquid, which is supplied to the centrifugal rotor, which central space is in communication with the separation chamber, the inlet device comprising a central body arranged centrally in the centrifugal rotor and surrounding said space, the central body at its one axial end having an opening which communicates with said central space, and an entrainment device having entrainment members arranged in said space for entrainment of said liquid by the rotation of the centrifugal rotor, the entrainment device is in such an engagement to the central body that it is entrained in its rotation and is prevented to move axially relative the same.

BACKGROUND OF THE INVENTION

Traditionally, an entrainment device of the kind here in question has been in engagement with the central body by means of screws or a nut; to make possible a change of the entrainment device. Such a change may take time, e. g. if several screws are used or if the screws or alternative attachment members are difficult to access. Many centrifugal separators are used in the food industry and in biotechnical processes, where high demands require that all surfaces exposed to a product be able to be cleaned very thoroughly. This means that surface contact between different separate details in a centrifugal rotor is not desirable, since such surface contact often creates gaps, which are difficult to clean. For accomplishment of as good ability to clean as possible, separate details in the centrifugal rotor may be formed such that they are in with each other at points or along short lines. Threads or seals, which may make cleaning more difficult, should be avoided if possible.

An object of the present invention is to provide an entrainment device for a centrifugal rotor, which entrainment device is easy to mount and dismount. Another object of the invention is to provide an entrainment device, which may be cleaned effectively in place in a centrifugal rotor.

SUMMARY OF THE INVENTION

According to the invention these objects may be obtained by means of an entrainment device of the initially mentioned kind, wherein the entrainment device comprises a first component, which surrounds the rotational axis and has at least one first projection, which has a radial extension, and a second component, which surrounds the rotational axis and has at least a second projection, which has a radial extension, the second component being axially introducible in said central space to a position, in which said second projection is present adjacent to said first projection; and that a locking member is applicable in engagement with said projection, when said entrainment device is in place in the central space, so that the second component is prevented to move axially relative the first component.

According to the invention, if desired, said first component and the central body may be connected to each other, but in a preferred embodiment of the invention the first component and the central body are formed in one piece or at least arranged to be fixedly connected to each other.

The first and the second component may be formed with just one first and just one second projection, respectively, as indicated above. In that case each of these projections may be formed such as an annular flange, which preferably extends substantially perpendicular to said rotational axis. However, in a preferred embodiment of the invention the first component has several first projections, which are distributed around the rotational axis and have a radial extension, leaving first interspaces between themselves, and the second component has several second projections, which are distributed around the rotational axis and have a radial extension, leaving second interspaces between themselves. Possibly, one of the components may have just one projection in the form of an annular flange, whereas the other of the components have several projections of the kind just described.

In the case each one of the components have several projections the entrainment device, if desired, may be formed so that said second projections are in said first interspace to a position axially at the same level as said first projections. However, in a preferred embodiment of the invention the entrainment device is formed such that the second projections are movable to a position, in which they have axially passed the first projections at the first component through said first interspace.

The locking device may be formed so that after being placed in a predetermined axial position relative said components, it may be turned so that portions of the same are in engagement with the projections of the components in a position in which the locking device prevents the components to move axially relative each other. However, in a preferred embodiment the locking device essentially has the shape of a ring having portions, which against the influence of a spring force may be moved towards or away from the rotational axis. With advantage, such a sub-annular locking device has an interruption in its extension around the rotational axis, so that different surrounding portions of the locking device may be conducted to and from engagement with the projections of the two components.

In the case the projections of the components extend radially towards said rotational axis, the locking device may be formed with a substantially U-shaped cross-section, the opening of which is directed away from the rotational axis. Thereby, the locking device may be brought to surround the projections partially and prevent them from moving axially relative each other.

In the case the entrainment device is formed in a way such that said second projections have been moved to a position, in which they have passed axially past the said first projections, the locking device may be in a space axially between the first and second projections. The locking device may then have a substantially circular cross-section.

The said projections may extend in different directions. Either, the projections on the one component are inwardly directed towards the rotational axis, whereas the projections on the other component are outwardly directed from the rotational axis, or all the projections are radially directed in the same direction.

In a particular embodiment of the invention the projections may be placed axially available outside the central body, but preferably the projections are placed within the central body and inwardly directed in the same direction towards the rotational axis. Hereby, substantially the entire entrainment device may be arranged within the central body in order to save space.

As initially stated the entrainment device is to be in engagement with the central body so that it is entrained in rotation therewith. This may be provided by a frictional engagement between the entrainment device and the central body by keeping the entrainment device by means of the locking device axially pressed to one or several portions of the central body. In order to bring about a forced engagement between the entrainment device and the central body the entrainment device may have at least a third projection extending away from the rotational axis and arranged to be inserted into a recess formed in the central body. Hereby, the relative rotational motion between the second component and the central body is effectively prevented.

For obtainment of point contact between separate details included in the entrainment device according to the invention, some or all of these details may be formed with knobs or rounded surfaces arranged so that they generate interspaces between adjacent, opposite surfaces.

The aforementioned entrainment devices may be constructed in any suitable way. For instance, they may be constituted by radially and axially extending vanes distributed around the rotational axis of the rotor. Alternatively, they may be constituted of a stack of with the central body and with each other arranged annular discs, giving a more lenient acceleration of incoming liquid than radially and axially extending vanes.

BRIEF DESCRIPTION OF THE DRAWINGS

The invention is to be further described in the following with reference to the accompanying drawing, in which FIG. 1 diagrammatically shows a conventional centrifugal rotor in axial section, provided with a central inlet device for liquid, which is to be treated in the centrifugal rotor, FIG. 2 in axial section and perspective shows a part of a central inlet device for a centrifugal rotor, provided with an entrainment device according to the invention.

DETAILED DESCRIPTION OF THE PREFERRED EMBODIMENTS

Figure 1:
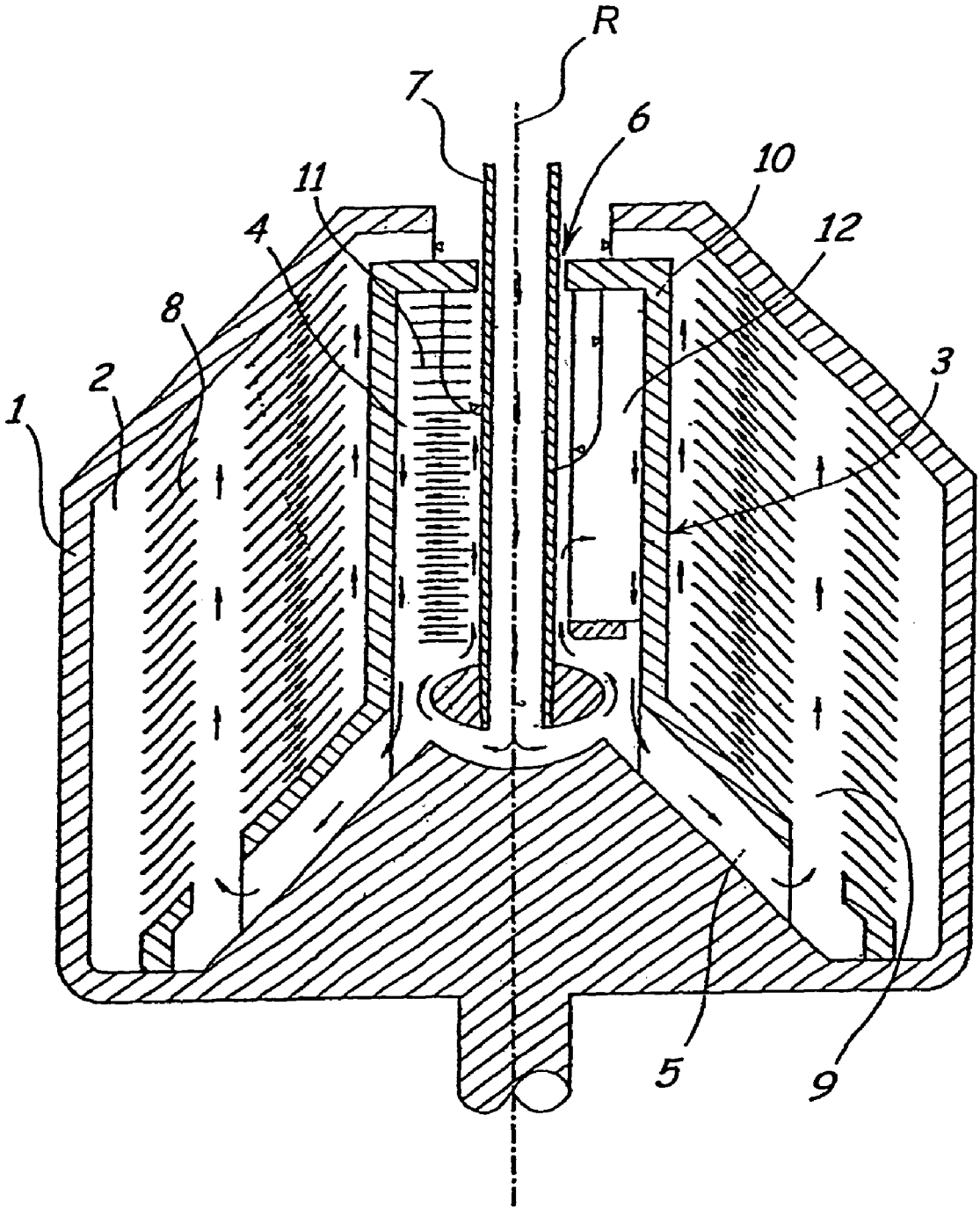
Fig. 1 PRIOR ART

In FIG. 1 there is shown a centrifugal rotor comprising a rotor body 1, which is rotatable around a vertical rotational axis R and which delimits a separation chamber 2. For rotation with the rotor body 1 an inlet device 3 is arranged centrally in the same. The inlet device 3 delimits a central space 4, which is in connection with the separation chamber 2 through channels 5, which are delimited between the inlet device 3 and the rotor body 1. Moreover, the inlet device 3 has an inlet opening 6 at its upper end that communicates with the space 4. A stationary inlet pipe 7 for liquid, which is to be treated in the centrifugal rotor, extends from above into the space 4 and opens in the lower part thereof. In the separation chamber 2 a stack of frustoconical separation discs 8 is arranged, which are axially separated so that they between themselves delimit thin flow paths for through flow of said liquid. Axially through the stack of separation discs 8 a number of distribution channels 9 extends, which are formed by holes in the discs 8 located right under each other.

The inlet device 3 comprises a central body 10, which surrounds the central space 4, and an entrainment device, which is placed in the central space 4. The entrainment device may be formed in different ways and has the function to entrain liquid entering the space 4 through the inlet pipe 7 in the rotation of the centrifugal rotor. In FIG. 1 two different kinds of entrainment members are illustrated, to the left respective to the right of the inlet pipe 7. To the left a stack of annular plane discs 11 is illustrated arranged to surround the rotational axis R at some axial distance from each other. To the right one of several wings 12 is illustrated, which are distributed around the rotational axis R and each one extending radially and axially.

A more complete description of the conventional centrifugal rotor in FIG. 1 may be found in U.S. Pat. No. 4,701,158.

Figure 2:
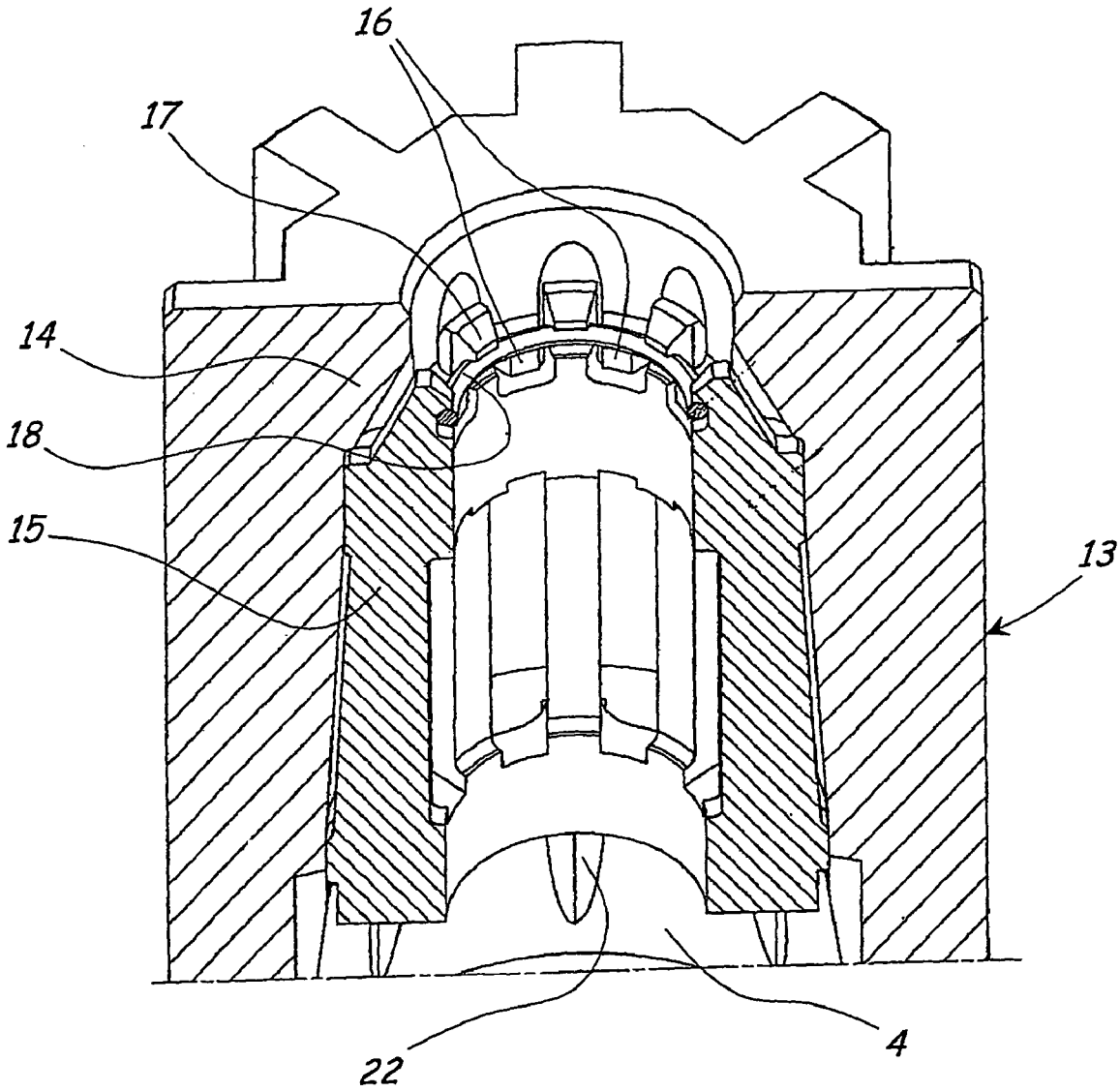

In FIG. 2 a first embodiment of an entrainment device according to the invention is shown. In this entrainment device both an upper part of a central body 13 (similar to the central body 10 in FIG. 1) and a separate entrainment body arranged in the space 4 within the central body 13 are included. The upper part of the central body 13 may be considered as a first component 14 and the separate entrainment body as a second component 15 of the entrainment device.

The first component 14 (i.e. the upper part of the central body 13) has several internal first projections 16 distributed around the rotational axis R and leaving first interspaces between themselves. The second component or the entrainment body 15 has several other projections 17 leaving second interspaces between themselves. The projections 16 and 17 have a radial extension and are inwardly directed towards the rotational axis R.

Figure 3:
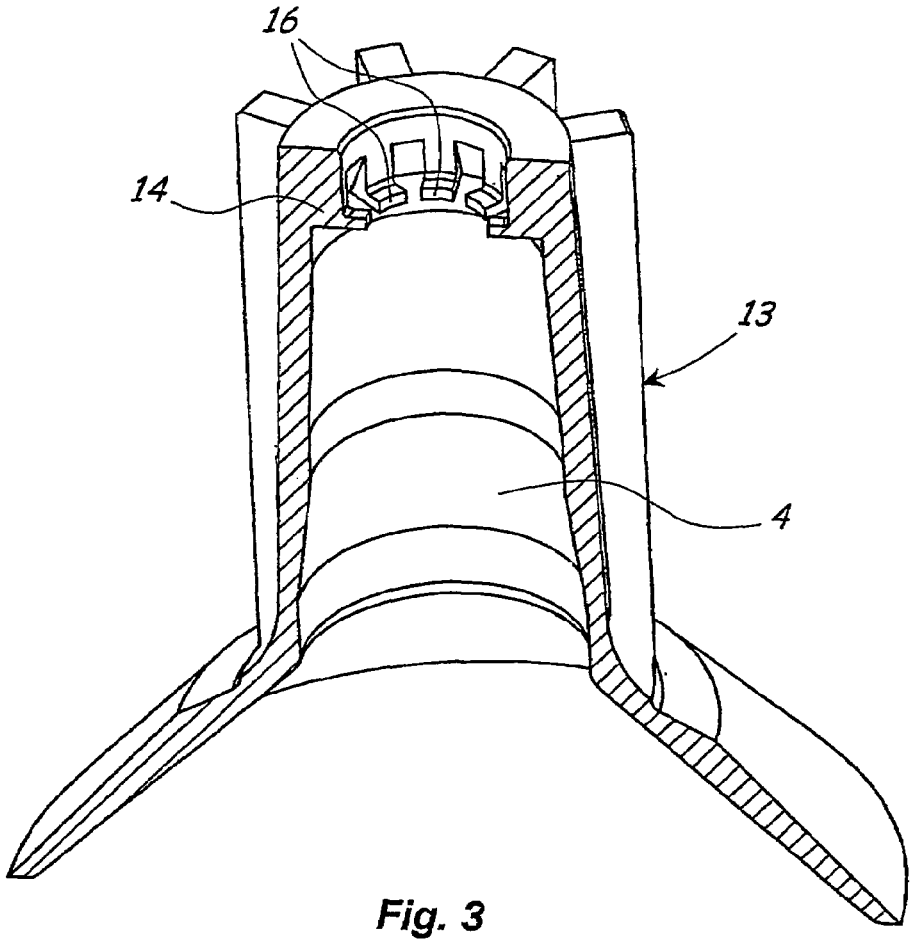
FIG. 3 shows a part of the entrainment device according to FIG. 2.
Figure 4:
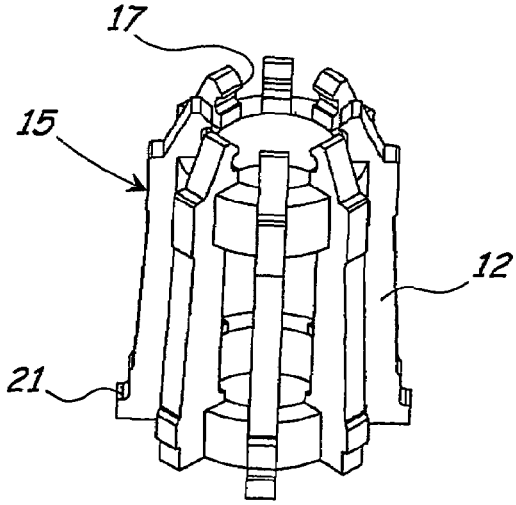
FIG. 4 shows an entrainment body being part of the entrainment device according to FIG. 2.

In FIG. 3 there is shown a central body 13 (somewhat modified) without any entrainment body 15 according to FIG. 2, and in FIG. 4 there is shown an entrainment device 15 of the kind as disclosed in FIG. 2.

As realized, the entrainment body 15 (according to FIG. 4) may be inserted in the space 4 from underneath in the central body 13 (according to FIG. 3) to a position, in which the projections 17 have passed and between the projections 16, and are situated axially somewhat above these, as disclosed in FIG. 2.

In FIG. 2 there is also shown a locking member 18, which is arranged axially between the first projections 16 and the second projections 17. The locking member 18 is substantially annular and has a circular cross-section. It has also a discontinuance in its extension around the rotational axis (not shown) enable it to be applied between the projections 16 and 17. In place between the projections 16 and 17 the locking member 18 keeps the entrainment body 15 relative the central body 13, so that the entrainment body 15 cannot fall out of the space 4.

The entrainment body 15 may be formed in different ways. Thus, the active entrainment members may be formed as, for example, annular plane discs 11 or as radially and axially extending wings 12. FIG. 4 shows an entrainment body 15 provided with wings 12, and FIG. 5 shows an entrainment body 15 provided with discs 11 of the respective kind as illustrated in FIG. 1.

Figure 5:
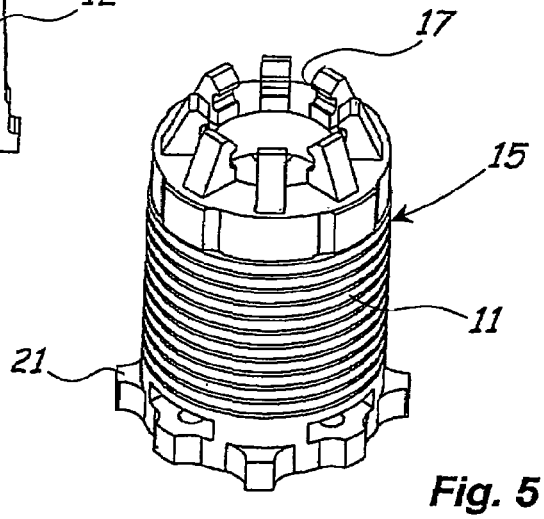
FIG. 5 shows an alternative embodiment of the entrainment body, which is shown in FIG. 4.

As disclosed in FIG. 4 and FIG. 5 the entrainment body 15 in addition to the projections 17 has some additional projections 21, which extend radially outwards at the lower part of the entrainment body 15. These projections 21 are intended to extend into corresponding grooves 22 formed on the inside of the central body 13, as illustrated in FIG. 2. Through an engagement occurred in this way between the projection 21 and the central body 13 the entrainment body is prevented from rotating relative the central body 13 in the space 4.

Figure 6:
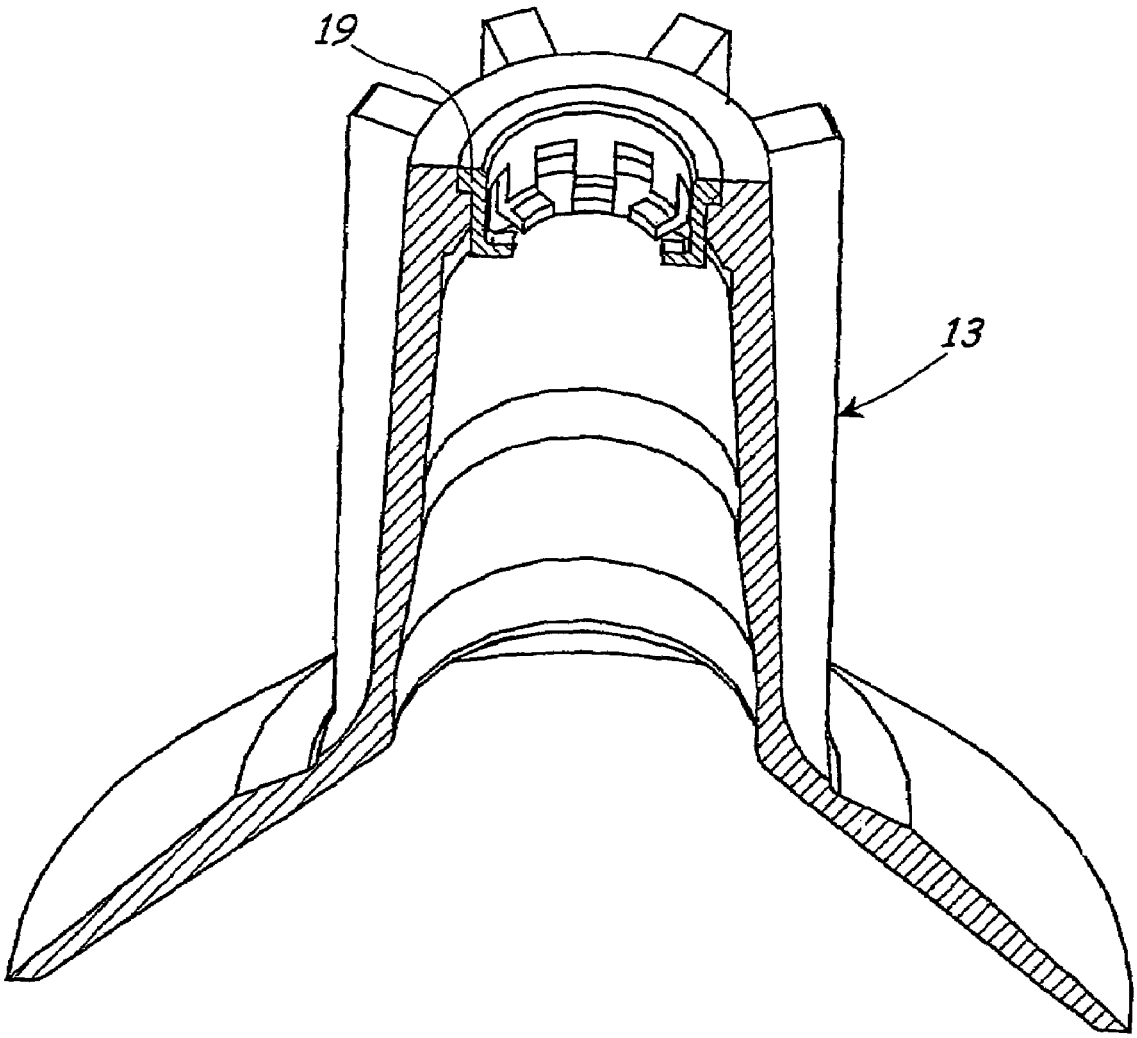
FIG. 6 shows an alternative embodiment of the part of the entrainment device, which is shown in FIG. 3.

In the embodiment of the invention shown in FIG. 2 the first component 14 is formed as one part with the central body 13. In FIG. 6 there is illustrated an alternative embodiment of the invention, in which the first component 14 is formed as a separate part 19. The separate part may be connected with the central body 13 in any suitable way. If necessary, separate fastening members may be arranged to keep the part 19 to the central body 13. Moreover, the separate portion or the component 19 according to FIG. 6 works in the same way as said first component 14 according to FIG. 3. If desired, the portion 19 may be provided with small elevations at its surfaces, which is to be in contact with the central body 13, resulting in point contact instead of surface-contact.

Figure 7:
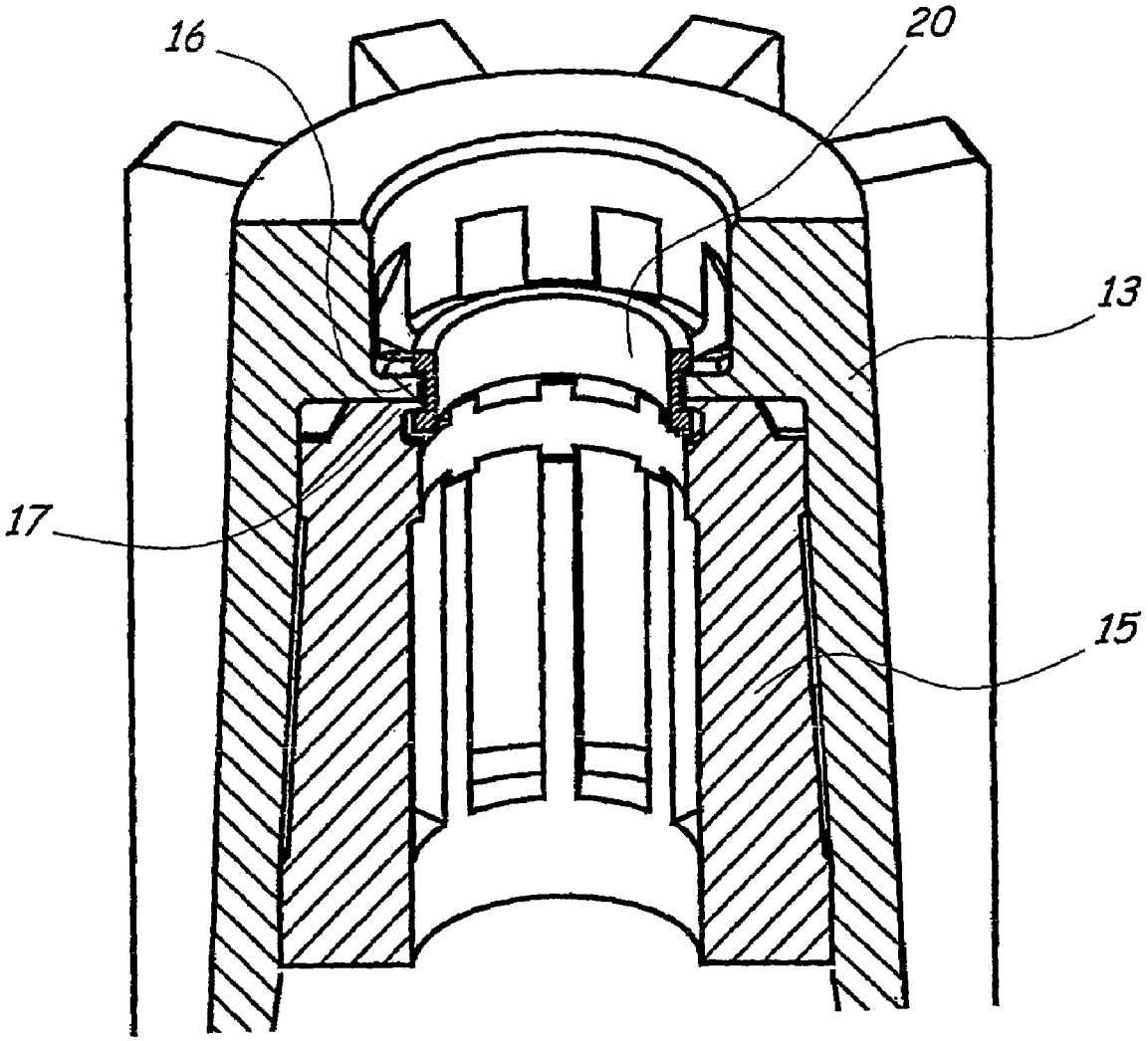
FIG. 7 shows a part of a central inlet device for a centrifugal rotor, provided with an alternative embodiment of the entrainment device according to the invention.

In FIG. 7 there is shown an additional embodiment of the invention, in which the central body 13 is formed with projections 16, in the same way as in FIGS. 2 and 3, and the entrainment body 15 is formed with projections 17, in the same way as in FIGS. 2 and 4. In FIG. 7 there is shown a modified locking member 20, which is annular with a discontinuance in its extension around the rotational axis R (not shown) and with a U-shaped cross-section, the opening of which is directed away from the rotational axis R.

As seen in FIG. 7 the entrainment body 15 is retained axially relative to the central body 13 by means of the locking member 20 when the projections 17 are situated in the interspaces between the projections 16 at the same axial level as the latter. The projections 16 as well as the projections 17 extend radially inwards towards the rotational axis R and are prevented from moving axially relative each other by the locking member 20.

What is claimed is:

1. An entrainment device for a centrifugal rotor, the rotor comprising:

a rotor body, which is rotatable about a central rotational axis and delimits a separation chamber; and an inlet device which is connected to the rotor body for rotation with the same and which delimits a central space for receiving of liquid, which is supplied to the centrifugal rotor, which central space is in communication with the separation chamber, the inlet device comprising;

a central body arranged centrally in the centrifugal rotor and surrounding said space, the central body at its one axial end having an opening which communicates with said central space; and an entrainment device having entrainment members arranged in said space for entrainment of said liquid by the rotation of the centrifugal rotor, the entrainment device is in such an engagement to the central body that it is entrained in its rotation and is prevented to move axially relative the same;

the entrainment device comprising a first component, which surrounds the rotational axis and has at least one first projection, which has a radial extension, and a second component, which surrounds the rotational axis and has at least a second projection, which has a radial extension, the second component being axially introducible in said central space to a position, in which said second projection is present adjacent said first projection; and a locking member in releasable engagement with said projections, when said entrainment device substantially is in place in the central space, so that the second component substantially is prevented from moving axially relative the first component.

2. An entrainment device according to claim 1, wherein the first component is arranged to be fixedly connected to the central body.

3. An entrainment device according to claim 1, wherein the first component and the central body are formed as one piece.

4. An entrainment device according to claim 1, wherein the first component has several first projections, which are distributed around the rotational axis and have a radial extension, leaving first interspaces between themselves, and the second component has several second projections, which are distributed around the rotational axis and have a radial extension, leaving second interspaces between themselves, said locking member being arranged to be in engagement with several of said projections at the respective components.

5. An entrainment device according to claim 4, wherein the second component is axially insertable in said central space to a position, in which said second projections is axially situated at the same level as said first projections at the first component in said first interspace.

6. An entrainment device according to claim 4, wherein the second component is axially in said central space to a position, in which said second projections have passed said first projections at the first component in said first interspace.

7. An entrainment device according to claim 6, wherein said locking device is substantially annular, is arranged to extend around said rotational axis and is applicable in a space axially formed between the first and the second projections when the second projections have passed the first projections.

8. An entrainment device according to claim 4, wherein said projections on the one as well as the other component extend radially in the same direction.

9. An entrainment device according to claim 8, wherein said projections on the one as well as the other component extend radially inwards towards the rotational axis.

10. An entrainment device according to claim 1, wherein said locking device is substantially annular and arranged to extend around said rotational axis.

11. An entrainment device according to claim 10, wherein the substantially annular locking device is resilient so that surrounding parts of the same are movable towards and away from the rotational axis.

12. An entrainment device according to claim 11, wherein the substantially annular locking device has a discontinuance in its extension around the rotational axis.

13. An entrainment device according to claim 12, wherein the substantially annular locking device has a substantially circular cross-section.

14. An entrainment device according to claim 12, wherein the substantially annular locking device has a substantially U-shaped cross-section with the opening directed away from the rotational axis.

15. An entrainment device according to claim 1, wherein said projections are arranged to be placed within the central body.

16. An entrainment device according to claim 1, wherein the second component comprises at least a third projection extending away from the rotational axis and arranged to be inserted into a recess formed in the central body, thereby preventing the relative rotational motion between the second component and the central body.

17. An entrainment device according to claim 1, wherein said entrainment member comprises radially and axially extending vanes.

18. An entrainment device according to claim 1, wherein the entrainment member comprises a stack of annular discs placed to said central body and each other.

* * * * *